US007188752B2

(12) United States Patent
Lecoutre

(10) Patent No.: US 7,188,752 B2
(45) Date of Patent: Mar. 13, 2007

(54) FLUID DISPENSER ASSEMBLY

(75) Inventor: Jean-Paul Lecoutre, Breteuil sur Iton (FR)

(73) Assignee: Valois S.A.S., Neubourg (FR)

( * ) Notice: Subject to any disclaimer, the term of this patent is extended or adjusted under 35 U.S.C. 154(b) by 106 days.

(21) Appl. No.: 10/730,899

(22) Filed: Dec. 10, 2003

(65) Prior Publication Data

US 2004/0118874 A1 Jun. 24, 2004

Related U.S. Application Data

(60) Provisional application No. 60/459,612, filed on Apr. 3, 2003.

(30) Foreign Application Priority Data

Dec. 11, 2002 (FR) ..... 02 15662

(51) Int. Cl.
*B67D 5/06* (2006.01)

(52) U.S. Cl. ..... 222/183; 222/105; 222/321.7; 222/321.9

(58) Field of Classification Search ..... 222/183, 222/105, 321.7, 321.9, 321.8, 182, 107, 143; 206/460–461, 497
See application file for complete search history.

(56) References Cited

U.S. PATENT DOCUMENTS

| | | | | |
|---|---|---|---|---|
| 3,469,743 | A * | 9/1969 | Becker | 222/105 |
| 3,698,551 | A | 10/1972 | Tomlinson | |
| 3,896,524 | A | 7/1975 | Parker | |
| 4,261,462 | A * | 4/1981 | Wysocki | 206/463 |
| 4,540,619 | A | 9/1985 | Watanabe | |
| 4,631,897 | A * | 12/1986 | Slavicek | 53/399 |
| 5,203,478 | A * | 4/1993 | de Laforcade et al. | 222/402.13 |
| 5,234,132 | A * | 8/1993 | Bachand et al. | 222/182 |
| 5,257,704 | A * | 11/1993 | Gutt | 215/246 |
| 5,454,209 | A * | 10/1995 | Kikuchi | 53/411 |
| 5,474,212 | A * | 12/1995 | Ichikawa et al. | 222/105 |
| 5,709,320 | A * | 1/1998 | Jimenez | 222/175 |
| 5,735,107 | A | 4/1998 | Vollenweider et al. | |
| 6,206,243 | B1 * | 3/2001 | Schneider et al. | 222/95 |
| 6,540,079 | B1 * | 4/2003 | Garcia et al. | 206/484 |
| 6,619,505 | B1 * | 9/2003 | Decottignies et al. | 222/95 |
| 6,637,964 | B1 * | 10/2003 | Kuo | 401/55 |
| 6,651,846 | B2 * | 11/2003 | Duquet et al. | 222/103 |
| 6,698,627 | B2 * | 3/2004 | Garcia et al. | 222/209 |
| 6,915,901 | B2 * | 7/2005 | Feinberg et al. | 206/363 |
| 2002/0020459 | A1 | 2/2002 | Baldwin et al. | |

FOREIGN PATENT DOCUMENTS

| | | |
|---|---|---|
| FR | 2 784 361 A | 4/2000 |
| GB | 626757 A | 7/1949 |

* cited by examiner

*Primary Examiner*—Frederick C. Nicolas
(74) *Attorney, Agent, or Firm*—Sughrue Mion, PLLC

(57) ABSTRACT

A fluid dispenser assembly having a fluid dispenser (1) and a wrapper (2) at least partly encasing the dispenser. The wrapper defines at least one application zone (21, 26) that comes into contact with the dispenser. The dispenser includes a body (10) forming at least one substantially cylindrical segment that defines an affixing zone for coming into contact with the application zone of the wrapper.

22 Claims, 3 Drawing Sheets

FLUID DISPENSER ASSEMBLY

CROSS REFERENCE TO RELATED APPLICATION

This application claims the benefit under 35 U.S.C. §119 (e) of pending U.S. provisional patent application Ser. No. 60/459,612, filed Apr. 3, 2003, and priority under 35 U.S.C. §119(a)-(d) of French patent application No. FR-02.15662, filed Dec. 11, 2002.

TECHNICAL FIELD OF THE INVENTION

The present invention relates to a fluid dispenser assembly comprising a fluid dispenser and a wrapper encasing said dispenser at least in part. The term "fluid" is used to mean any substances or products in liquid form, in semi-liquid form, or even in powder form that are for application on an application surface or for dispensing into the atmosphere. This type of dispenser assembly is encountered, in particular, in the fields of pharmaceuticals, cosmetics, or indeed perfumes.

BACKGROUND OF THE INVENTION

In the prior art, Document FR-2 784 361 describes packaging for a substance. That packaging comprises a dispenser having a deformable actuating wall encased in a wrapper through which the wall of the dispenser can be actuated. The dispenser in that document has a substantially flat or low-thickness configuration. On one side, the dispenser is fully plane, whereas on the other side it forms a convex dome defining the actuating wall which can be pushed in. Thus, by pressing on the actuating wall, e.g. by means of one finger or of one hand, it is possible to reduce the internal volume of the reservoir of the dispenser, and thereby to deliver a portion of the fluid that it contains as a mixture with a gas, e.g. air. A sprayed mixture of the fluid and of air is thus obtained at the outlet of the dispenser. The wrapper extends at least over the reservoir of the dispenser in the form of a flap which covers the actuating wall. The cross-section of the wrapper is in the form of a segment of a cylinder. In other words, the flap that covers the actuating wall has a curved configuration, while the other portion of the wrapper merely covers the plane back face of the dispenser. The wrapper is in contact with and is fixed to the dispenser at the back face and/or at the margins of the front face defining the actuating wall. That is a particular type of dispenser assembly implementing a particular dispenser and a specific wrapper adapted thereto.

SUMMARY OF THE INVENTION

An object of the present invention is to define another type of dispenser assembly also made up of a dispenser and of an encasing wrapper. However, both the dispenser and the wrapper have configurations that are totally different from those of the above-mentioned prior art document.

The present invention provides a fluid dispenser assembly comprising: a fluid dispenser; and a wrapper encasing said dispenser at least in part, said wrapper defining at least one application zone for coming into contact with the dispenser; said dispenser assembly being characterized in that the dispenser comprises a body forming at least one substantially cylindrical segment, said segment defining an affixing zone for coming into contact with the application zone of the wrapper. The dispenser of the present invention thus differs significantly from the prior art dispenser in that it preferably has a generally cylindrical configuration, in which at least one substantially cylindrical segment serves as an affixing surface into which the wrapper comes into contact. The contact may also serve as a point or zone for fixing the wrapper to the dispenser. The dispenser that can be used in the present invention is of relatively conventional appearance in the form of small cylinders mostly forming a fluid reservoir which is associated with a dispenser member such as a pump or a valve. The actuating head of the pump or of the valve may be capped with a protective cap which supplements the overall cylindrical shape of the dispenser. However, it is not necessary for the body to be fully cylindrical: it is necessary merely for it to define at least one substantially cylindrical segment over a portion of its height.

Advantageously, the wrapper defines a substantially cylindrical recess for receiving the dispenser, said recess defining the application zone.

In another characteristic, the wrapper comprises at least one sheet shaped to match the shape of the dispenser at least in part, said sheet defining at least one application zone. Advantageously, the wrapper is made up of two sheets that are shaped to match the shape of the dispenser at least in part, each sheet defining at least one application zone. In which case, the two sheets may be connected together on either side of the dispenser substantially symmetrically about the dispenser. Preferably, the two sheets together define two junction zones situated on either side of the dispenser, the two zones extending in a common plane. Advantageously, each of the junction zones forms a respective junction plane. Preferably, the two sheets may be disposed symmetrically about the junction plane.

According to another characteristic of the invention the application zone of a sheet extends substantially over nearly one half of the periphery of the substantially cylindrical segment. Thus, the sheet may encase the body of the dispenser either over nearly one half of its periphery or only over a smaller zone as a function of the curvature of the sheet relative to the profile of the substantially cylindrical segment defining the affixing zone on the dispenser.

According to an advantageous characteristic of the invention, at least one sheet has a face that is adhesive at least in part. In practice, one of the faces of the sheet is coated entirely with a self-adhesive adhesive, but the minimum requirement is for at least the application zone to be coated with an adhesive. Preferably, the junction zone(s) is/are also coated with an adhesive at least in part.

In another aspect the invention, the dispenser comprises a dispenser head that projects from the wrapper, said head advantageously being capped by a removable protective cap situated outside the wrapper. The dispenser may then be in the form of a miniature vaporizer having a reservoir that is generally cylindrical in shape, e.g. underlying a pump capped by a cap.

The present invention also provides a method of manufacturing such a dispenser assembly comprising the following steps:

a) causing a dispenser comprising a body defining a substantially cylindrical segment forming an affixing zone to be brought between two sheets, at least one of which is adhesive in part; and
b) exerting pressure to bring the two sheets into contact with each other and with the dispenser so that the adhesive sheet adheres to the other sheet and to the affixing zone on the dispenser.

Thus, the dispenser assembly may be manufactured in the manner of a sandwich by disposing a dispenser of the conventional vaporizer type between two deformable or shaped sheets advantageously coated with an adhesive so that they adhere to each other and to the body of the dispenser. Naturally, one or even both of the sheets may be pre-shaped so as to match the shape of and to fit around the dispenser. However, preferably, it is possible to use flexible plane sheets that are brought into contact with the dispenser and also with each other by means of a suitable press device.

BRIEF DESCRIPTION OF THE DRAWINGS

The invention is described more fully below with reference to the accompanying drawings which, by way of non-limiting example, show two embodiments of a dispenser assembly of the invention and manufacturing apparatus for manufacturing a dispenser assembly of the invention.

In the figures.

DETAILED DESCRIPTION OF THE INVENTION

Figure 1:
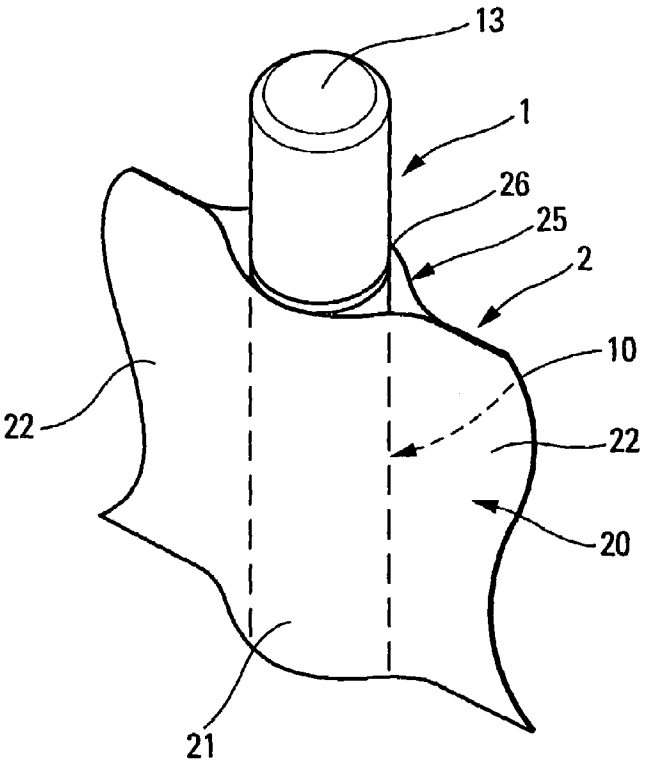
FIG. 1 is a perspective view seen looking from above of a first embodiment of a dispenser assembly of the invention.
Figure 2:
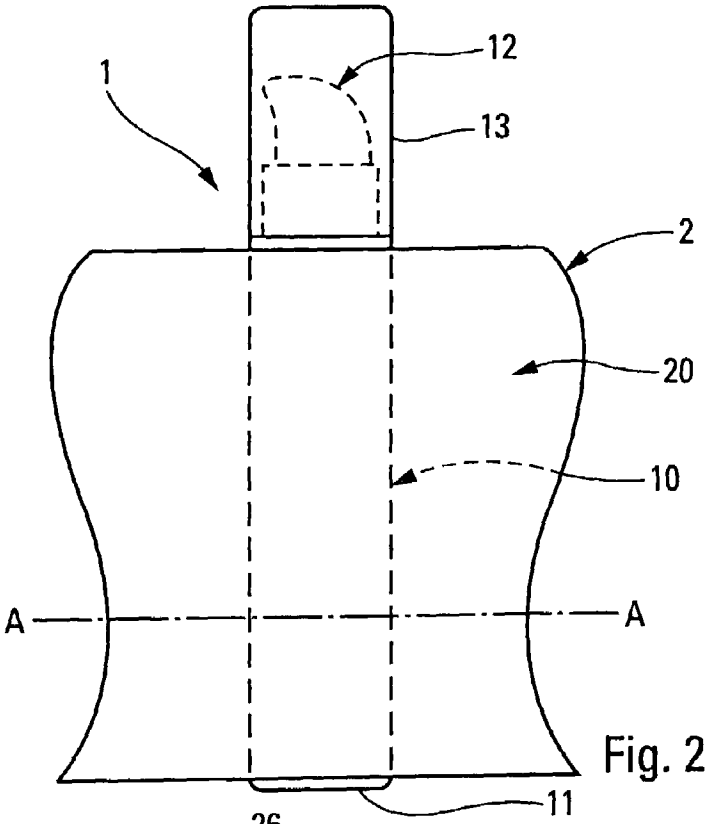
FIG. 2 is a partially transparent plan view of the dispenser assembly of FIG. 1.
Figure 3:
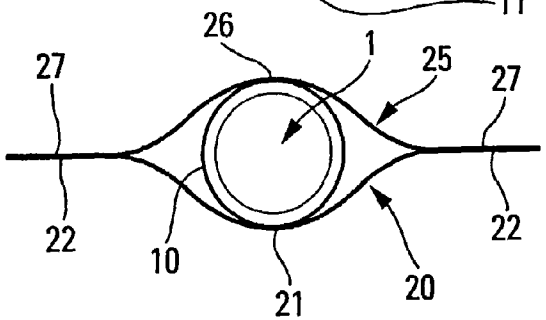
FIG. 3 is a horizontal cross-section view on the section line A—A of FIG. 2.

In the two embodiments shown in the figures, the dispensing assembly is made up of two component elements, namely a fluid dispenser 1 or 1' and a wrapper 2 or 2' encasing the dispenser at least in part. With reference to FIGS. 1 to 3, it is possible to see that the fluid dispenser 1 comprises a body 10 which, in this example, is fully cylindrical in overall shape, and has an end-wall 11 at one of its ends, while its other end is provided with a dispensing head 12 (shown in dashed lines), that can advantageously be actuated by being pushed to dispense a metered quantity or "dose" of fluid contained in the body 10. Advantageously, the dispensing head 12 is mounted on a pump 14 or a valve, and is capped with a protective cap 13 whose shape and outside diameter extend the cylindrical shape of the body 10. The pump or valve may have an actuation stem: the head is mounted on the stem.

This is merely a preferred embodiment. The body 10 of the dispenser 1 may be shaped or configured so as not to be fully cylindrical, while retaining at least one segment that is substantially cylindrical over its height. Moreover, the body does not necessarily contain or does not necessarily form a fluid reservoir. It may also form a sleeve containing an element of the dispenser. The cap 13 is an optional element. Similarly, the dispensing head may be replaced by any dispensing member or even by an applicator. For example, the dispenser may also be lipstick-shaped. An important characteristic of the dispenser is that its body defines at least one substantially cylindrical segment, even if it is not cylindrical over its entire height. Preferably, the dispenser incorporates a dispensing member such as a valve, and preferably a pump, on which the dispensing head is mounted, which head may, for example, be in the form of a pusher that can be actuated by using a finger of one hand. The pusher may even incorporate a dispensing orifice in the form of a spray nozzle, making it possible to spray the fluid.

Thus, in the embodiment shown in FIGS. 1 to 3, the body 10 is fully circularly cylindrical. However, it is possible to imagine other cross-sectional shapes for the body 10. For example, the cylinder formed by the body may be of oval, ellipsoid, or even polygonal cross-section. The body of the dispenser is then more like a tube having any one of a variety of cross-sections. However, it still satisfies the definition of a cylinder.

The wrapper 2 surrounds, masks or encases the body 10 at least in part, it being possible for the end-wall 11 and the cap 13 to remain visible, e.g. by projecting from the wrapper. However, the end-wall 11 may also remain inside the wrapper, as may the cap 13. In which case, the wrapper may have a removable or detachable portion making it possible to unmask the cap 13 to enable it to be removed. However, in the embodiment shown in FIGS. 1 to 3, the wrapper 2 encases a portion of the body 10 only, namely most of it except for the end-wall 11 and the top end portion situated immediately below the cap 13.

The wrapper 2 is made up of two sheets 20 and 25 which may be made of any material suitable for being machined into a sheet, plate, film, or rolled leaf, or a laminate thereof. The sheets may be of identical type or of different type. For example, the sheets may be made of a paper, card, plastic, or metal, or of a laminate thereof. The sheets 20 and 25 may be flexible, rigid, semi-rigid, or thermally or mechanically deformable. Two sheets 20 and 25 are described, but the two sheets may, for example be formed of one piece of sheet made up of two sheet segments hinged to each other. One or preferably both of the sheets may be provided with an aesthetically-pleasing outer periphery that can be adapted as a function of the type of dispenser of the dispenser assembly.

In the invention, the fluid dispenser 1 is disposed between the two sheets 20 and 25 which thus encase the body 10 of the dispenser. Since the body 10 of the dispenser defines a fully cylindrical shape, the two sheets 20 and 25 come into contact with the body 10 at a longitudinal affixing zone formed over the height of the body 10. In corresponding manner, the two sheets 20 and 25 define respective application zones 21 and 26 that come into contact with the affixing zones of the body 10.

In the invention, each sheet defines two side junction zones 22, 27 which extend on either side of the respective application zone 21, 26. The two junction zones 22 defined by the sheet 20 serve to come into contact with the junction zones 27 defined by the sheet 25. Advantageously, the two sheets 20 and 25 are fixed together at said junction zones 22, 27. Preferably, each of the junction zones forms a junction plane, and said junction planes extend in a common plane advantageously passing through the body 10 of the dispenser 1, as can be seen clearly in FIG. 3.

Thus, it can be said that the wrapper forms a substantially cylindrical central recess inside which the body 10 of the dispenser extends. The central recess is flanked on either side by two advantageously plane fins which extend in a common plane. The fins defined by the junction zones of the sheets may be shaped at their outlines to impart aesthetically attractive appearances to them. Advantageously, the two sheets are totally identical and they are shaped identically around the dispenser. Since the sheets 20 and 25 are joined together on either side of said central recess, it is necessary for them to be shaped around the dispenser at said recess. Since the body 10 is of cylindrical cross-section, and of circularly cylindrical cross-section in this example, each sheet must be shaped around the dispenser in the form of a longitudinal bulge or curve which defines a segment of cylinder. The areas of the affixing zones and of the application zones vary as a function of the curvature of the sheets at the dispenser. In the embodiment shown in FIGS. 1 to 3, the central recess receiving the dispenser has a substantially eye-shaped cross-section inside which the dispenser is received so that said dispenser can be likened to the pupil of the eye. This can be seen clearly in FIG. 3. In this case, the two affixing zones on the body 10 and the two application zones on the sheets 20 and 26 are formed by the sheets coming into tangential contact with the dispenser. Naturally, by accentuating the curvature or the bulge of the sheets, the affixing zones and the application zones can be extended so as then to form a segment or portion of cylinder. With reference briefly to the second embodiment, and more particularly to FIG. 6, it can be seen that the two sheets may be shaped so that each of them extends in contact with the dispenser over nearly one half of the periphery of said dispenser, so that the recess formed by the two sheets is then in the shape of a cylinder which is in contact with the dispenser over its entire inside periphery.

For fixing the sheets together and to the dispenser, it is possible to make provision for the inside faces of the sheets, i.e. the faces that face each other, to be covered or coated with a suitable adhesive enabling them to be fixed securely both to the body of the dispenser and to each other. Naturally, it is possible to imagine other fixing means, e.g. heat-sealing or mechanical fixing means. The advantage offered by using self-adhesive sheets lies in the fact that it is very easy to determine the shape of the recess for receiving the dispenser, and the surface areas of the affixing zones and of the application zones, and thereby also of the side junction zones.

The side edges 28 of the wrapper, which edges are preferably formed by the outer edges of the junction zones of the two sheets, preferably have a certain amount of rigidity or stiffness so that it is easy for the user to take hold of the dispenser assembly by said side edges so that the assembly is held well in the hand. It is for instance possible to push on the dispenser head while maintaining the assembly by the outer side edges of the wrapper. Thus, the aesthetically pleasing periphery of the wrapper may also have a functional aspect related to it being taken hold of in the hand. Another function of the wrapper is to extend the working surface area that can be used to bear notices and indications relating to the fluid, to its composition, and to how to use it. Thus, the two sheets 20 and 25 may be identical in shape but printed differently.

In the example shown in FIGS. 1 to 3, the two sheets 20 and 26 are shaped in symmetrically identical manner. However, it is possible to obtain a dispenser assembly of the invention by using one sheet that is fully plane and one sheet that is shaped. The plane sheet then comes into tangential contact with the dispenser while the other sheet is highly shaped or deformed to pass over the dispenser. In which case, the side junction zones may extend in a common plane passing tangentially to one side of the dispenser rather than passing through the middle of the dispenser. It is recalled that the sheets may be initially plane, and then shaped by being deformed around the dispenser or, in a variant, at least one of the sheets is pre-shaped, e.g. by thermoforming, so as to match the shape of the dispenser.

Figure 4:
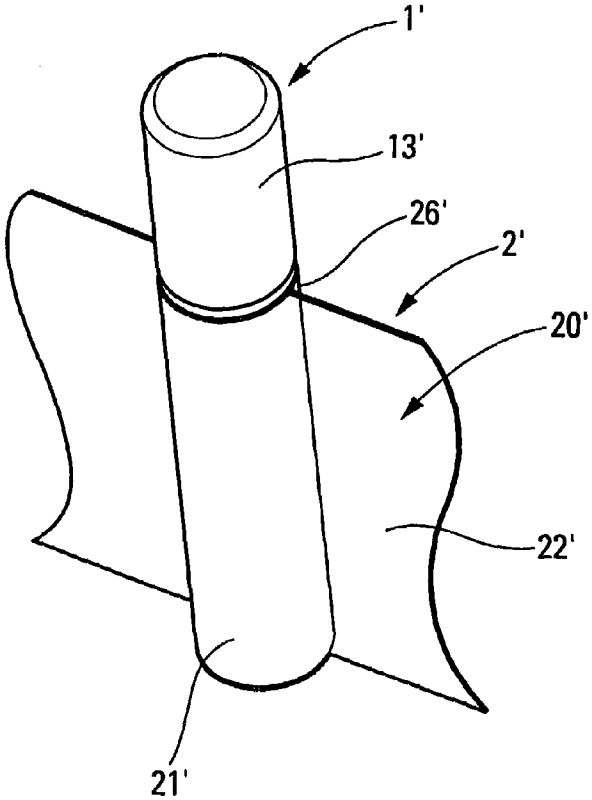
FIG. 4 is a perspective view seen looking from above of a second embodiment of a dispenser assembly of the invention.
Figure 5:
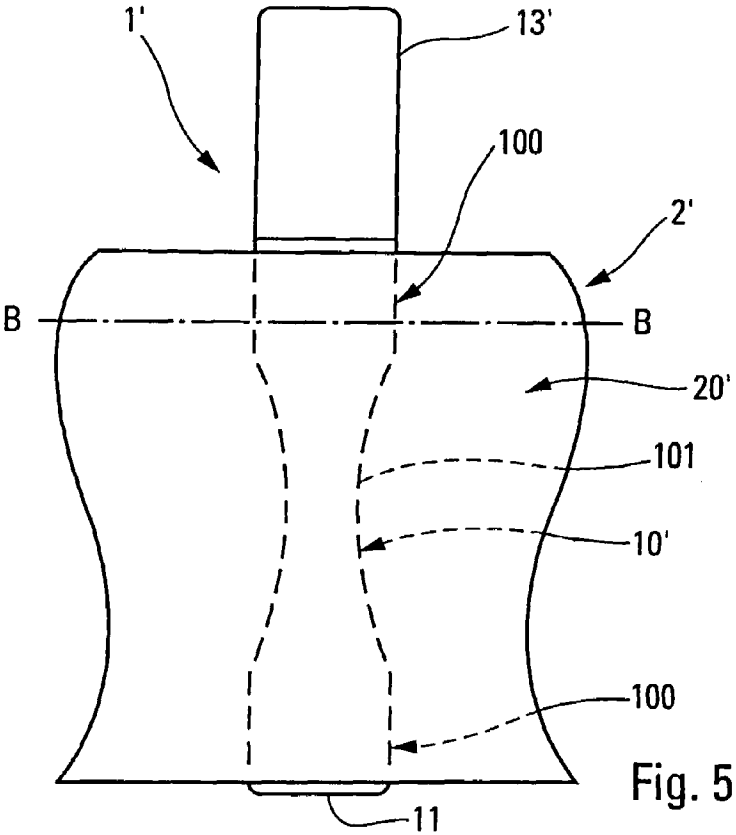
FIG. 5 is a partially transparent plan view of the dispenser assembly of FIG. 4.
Figure 6:
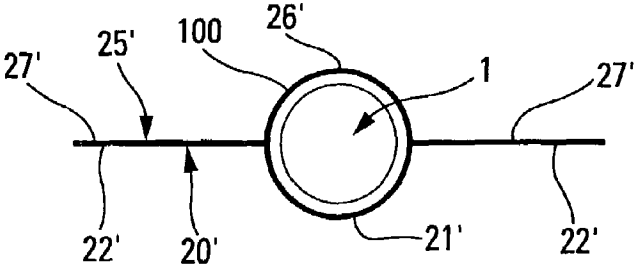
FIG. 6 is a horizontal cross-section view on the section line B—B of FIG. 5.

Reference is made briefly below to FIGS. 4 to 6 which show a variant embodiment.

A first difference relative to the first embodiment lies in the shape 10' of the dispenser 1' which, in this example, is not fully cylindrical, but rather is shaped concavely to define a substantially central zone 101 that is hourglass-shaped. The central zone 101 is flanked at either end by two substantially cylindrical segments 100 which define the affixing zones of the body 10'. In this example, the wrapper 2' is also made up of two sheets 20' and 25', each of which defines a respective application zone 21', 26' in fixing contact with a respective one of the apposition zones 100 on the body 10'. Thus, the sheets 20' and 25' of the wrapper 2' do not come into contact with the body 10' at the hourglass-shaped central zone 101. As shown in FIG. 4, the hourglass-shaped central zone 101 is not visible from the outside because the two sheets 20' and 25' define a cylindrical central recess that does not match the outside shape of the body 10'.

A second difference relative to the first embodiment, and that is mentioned above, lies in the more snugly encasing shapes of the sheets 20' and 25'. As can be seen in FIG. 6, each of the sheets defines a respective half of the recess in the shape of a respective half-cylinder 21', 26' that is in contact with the substantially cylindrical segments 100 over nearly one half of their peripheries.

In this embodiment, the wrapper 2' is thus in the form of a central recess matching the shape of the substantially cylindrical segment(s) defining the affixing zones of the dispenser, the central recess being flanked on either side by respective junction zones which extend into contact with the dispenser. In this example too, it is possible to implement a wrapper in which the common plane of the junction zones does not pass through the center of the dispenser, but rather in offset manner, e.g. offset tangentially.

Figure 7:
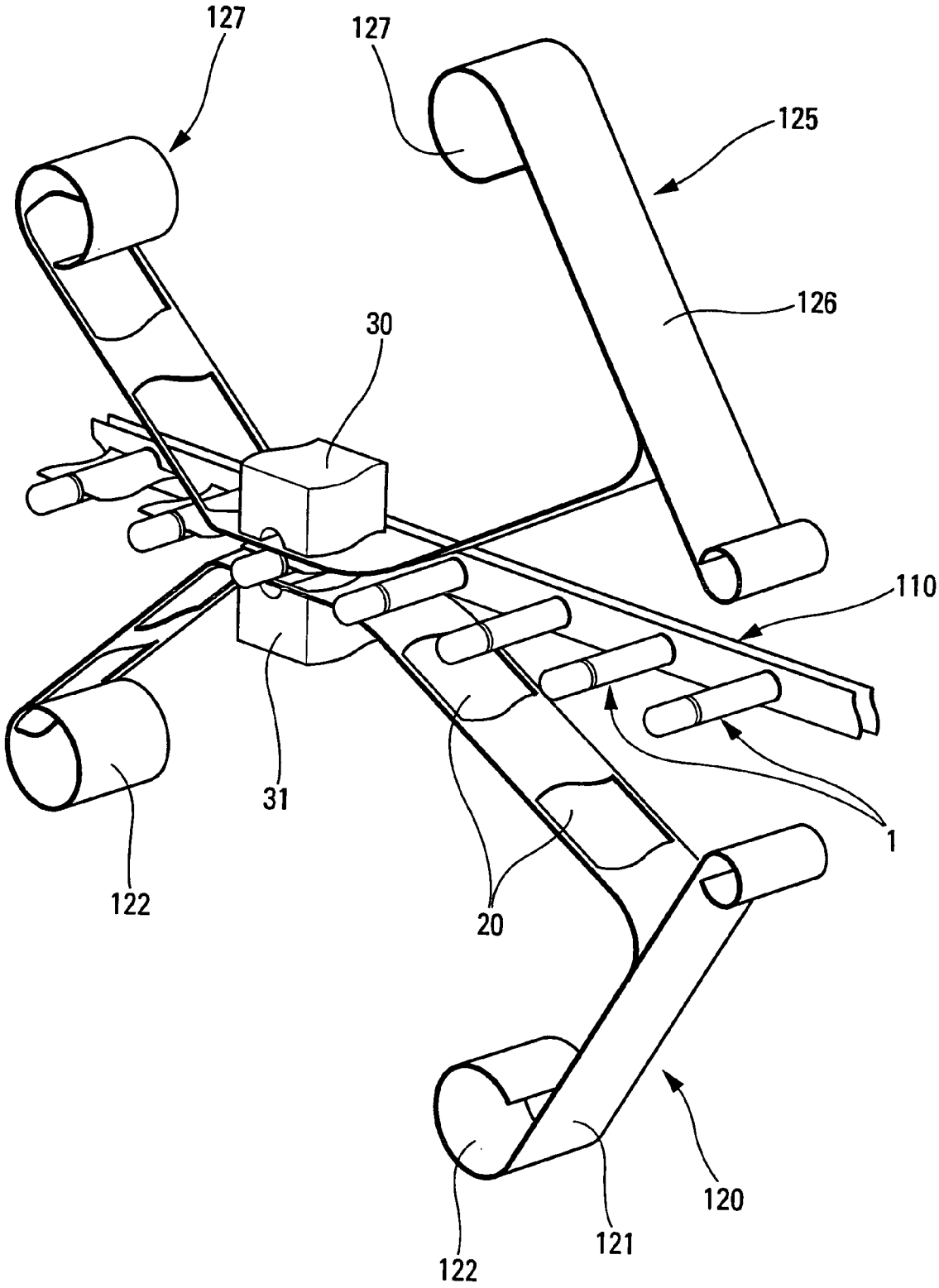
FIG. 7 is a diagrammatic perspective view given for the purpose of illustrating the method of manufacturing a dispenser assembly of the invention.

Reference is made below to FIG. 7 to explain a manufacturing method that can be used to manufacture a dispenser assembly of the invention. The manufacturing method may, for example, be implemented by a machine making it possible to bring bare fluid dispensers in succession between respective wrapper sheets that are then pressed together to come into contact with the dispenser and with each other. For example, the machine may comprise a dispenser support 110 having a plurality of locations suitable for receiving and holding dispensers 1. The dispensers are thus held side-by-side with the necessary spacing between them. The support device 110 is preferably movably mounted so that it can move the dispensers in succession stepwise. In addition, the manufacturing machine makes it possible to unroll two rolls 120 and 125, each of which is constituted by an adhesive tape 122, 127 disposed on a non-stick substrate 121, 126. The adhesive tapes 122 and 127 are pre-cut so as to define portions of tape that can be detached from the remainder of the tape in question, and naturally from the non-stick substrate in question. The portions of tape to be detached define the wrapper sheets. The machine integrates means making it possible to separate the non-stick substrate 121, 126 from the adhesive tape 122, 127 so as to cause only the adhesive tape 122, 127 to advance between two press jaws 30 and 31. Thus, at each step, the two adhesive tapes advance in unison to dispose a piece of adhesive tape on either side of a bare dispenser supported by the support 110. The pressing surfaces of the press jaws 30 and 31 are configured to apply the two adjacent pieces of tape against the dispenser 1, and against each other at the side junction zones. As a function of the shape of the jaws, the wrapper hugs the dispenser to various extents (see FIGS. 3 and 6). Once the jaws 30 and 31 move apart, the support 110 can move through one step in order to extract the finished dispenser assembly and in order to bring a new bare dispenser between the jaws. In symmetrical manner, the tapes advance through one step so as to bring new pieces of tape between the jaws around the bare dispenser. The wrapping can thus be achieved relatively simply with an uncomplicated machine and by means of two pieces of self-adhesive tape applied one against the other, with a bare dispenser interposed between them.

The invention claimed is:

1. A fluid dispenser assembly comprising:

a fluid dispenser (1); and a wrapper (2) encasing said fluid dispenser at least in part, said wrapper defining at least one application zone (21, 26; 21', 26') that contacts the dispenser, wherein the wrapper comprises two outer side edges (28) by which the assembly is held securely in a hand; and wherein the dispenser comprises a body (10) forming at least one substantially cylindrical segment, said segment defining an affixing zone that contacts the application zone of the wrapper, and the dispenser further comprises a dispenser head that actuates the dispenser when depressed while holding the wrapper by the two outer side edges.

2. A dispenser assembly according to claim 1, in which the wrapper (2) defines a substantially cylindrical recess for receiving the dispenser, said recess defining the application zone.

3. A dispenser assembly according to claim 1, in which the wrapper comprises at least one sheet (20, 25; 20', 25') shaped to match the shape of the dispenser at least in part, said sheet defining at least one application zone.

4. A dispenser assembly according to claim 1, in which the wrapper is made up of two sheets (20, 25; 20', 25') that are shaped to match the shape of the dispenser at least in part, each sheet defining at least one application zone.

5. A dispenser assembly according to claim 4, in which the two sheets are connected together on either side of the dispenser substantially symmetrically about the dispenser.

6. A dispenser assembly according to claim 4, in which the two sheets together define two junction zones (22, 27; 22', 27') situated on either side of the dispenser, the two zones extending in a common plane.

7. A dispenser assembly according to claim 6, in which each of the junction zones forms a respective junction plane.

8. A dispenser assembly according to claim 3, in which the at least one application zone of said sheet extends substantially over nearly one half of the periphery of the substantially cylindrical segment.

9. A dispenser assembly according to claim 3, in which the at least one sheet has a face that is adhesive at least in part.

10. A dispenser assembly according to claim 9, in which the at least one application zone is coated with an adhesive.

11. A dispenser assembly according to claim 6, in which at least one of the junction zones is coated with an adhesive.

12. A dispenser assembly according to claim 1, in which the dispenser comprises the dispenser head (12) that projects from the wrapper, said head advantageously being capped by a removable protective cap (13) situated outside the wrapper.

13. A dispenser assembly according to claim 7, in which the two sheets are disposed symmetrically about the junction plane.

14. A method of manufacturing a dispenser assembly according to claim 1, comprising the following steps:

a) causing the dispenser comprising the body defining the substantially cylindrical segment forming the affixing zone to be brought between two sheets, at least one of which is adhesive in part; and b) exerting pressure to bring the two sheets into contact with each other and with the dispenser so that the adhesive sheet adheres to the other sheet and to the affixing zone on the dispenser.

15. A method according to claim 14, in which the at least one sheet is deformed during step (b).

16. The dispenser assembly according to claim 1, further comprising a reservoir comprising fluid and pump that dispenses the fluid from the reservoir.

17. The dispenser assembly according to claim 1, wherein the body defines a reservoir that contains fluid.

18. The dispenser assembly according to claim 1, wherein each of the two outer side edges are on opposite sides of the fluid dispenser.

19. A fluid dispenser assembly comprising:

a dispenser;

a dispensing head that actuates the dispenser when depressed; and a wrapper encasing at least a portion of the dispenser and defining at least one application zone that contacts the dispenser and wings that extend away from the dispenser, and wherein the dispensing head extends beyond the wrapper; and wherein the dispenser assembly is structured to be actuated by gripping the wings while depressing the dispensing head.

20. The dispenser assembly according to claim 19, further comprising a cylindrical reservoir comprising fluid and pump that dispenses the fluid from the reservoir.

21. A fluid dispenser assembly comprising:

a fluid dispenser; and a wrapper encasing the fluid dispenser at least in part, said wrapper defining at least one application zone that contacts the dispenser; and wherein the dispenser comprises a fluid reservoir forming at least one substantially cylindrical segment, said segment defining an affixing zone that contacts the application zone of the wrapper, and the dispenser further comprises a moveable dispenser head that actuates the dispenser when depressed while holding the assembly by the wrapper; and wherein the wrapper is made up of two sheets that are shaped to match the shape of the dispenser at least in part, each sheet defining at least one application zone.

22. A fluid dispenser assembly comprising:

a dispenser;

a dispensing head that actuates the dispenser when depressed; and a wrapper made up sheet material encasing at least a portion of the dispenser and defining at least one application zone that contacts the dispenser and void zones between the dispenser and the wrapper;

wherein the dispensing head extends beyond the wrapper; and wherein the dispenser assembly is structured to be actuated by gripping opposite side edges of the wrapper while depressing the dispensing head, the side edges of the wrapper extending longitudinally in a direction parallel to a longitudinal direction of the dispenser.

* * * * *